US006808546B2

(12) United States Patent
Schottler

(10) Patent No.: US 6,808,546 B2
(45) Date of Patent: Oct. 26, 2004

(54) DEVICE AND METHOD FOR EXHAUST AIR PROCESSING, IN PARTICULAR, FOR CLEAN ROOM DEVICES

(75) Inventor: Martin Schottler, Stuttgart (DE)

(73) Assignee: M+W Zander Facility Engineering GmbH, Stuttgart (DE)

( * ) Notice: Subject to any disclaimer, the term of this patent is extended or adjusted under 35 U.S.C. 154(b) by 0 days.

(21) Appl. No.: 10/064,984

(22) Filed: Sep. 6, 2002

(65) Prior Publication Data

US 2003/0050004 A1 Mar. 13, 2003

(30) Foreign Application Priority Data

Sep. 6, 2001 (DE) ..... 101 43 628

(51) Int. Cl.[7] ..... F24F 7/00

(52) U.S. Cl. ..... 55/385.2; 55/473; 96/132; 96/138; 96/142; 454/187

(58) Field of Search ..... 55/385.2, 473; 96/132, 138, 142; 454/187

(56) References Cited

U.S. PATENT DOCUMENTS 4,699,640 A * 10/1987 Suzuki et al. ..... 55/385.2
5,122,170 A * 6/1992 Satoh et al. ..... 55/385.2
5,169,418 A * 12/1992 Honda et al. ..... 55/385.2
5,350,336 A * 9/1994 Chen et al. ..... 55/385.2
5,827,339 A * 10/1998 Nagafune et al. ..... 55/385.2
5,828,572 A * 10/1998 Hasegawa et al. ..... 454/187
6,033,301 A * 3/2000 Suwa ..... 454/187
6,306,189 B1 * 10/2001 Renz ..... 55/385.2
6,358,139 B1 * 3/2002 Rentz ..... 454/187
6,572,468 B1 * 6/2003 Sasaki et al. ..... 454/187

* cited by examiner

*Primary Examiner*—Blaine Copenheaver
*Assistant Examiner*—Minh-Chau T. Pham
(74) *Attorney, Agent, or Firm*—Gudrun E. Huckett

(57) ABSTRACT

A device for exhaust air processing of clean rooms has a least one fresh air supply and at least one exhaust air device connected to a work room. At least one processing device is arranged in the work room. At least one supply line and at least one exhaust air line are connected to the processing device. At least one first filter is arranged in the at least one exhaust air line of the processing device, wherein the at least one exhaust air line is connected at least to one of the supply line of the processing device and the fresh air supply line of the work room.

19 Claims, 3 Drawing Sheets

DEVICE AND METHOD FOR EXHAUST AIR PROCESSING, IN PARTICULAR, FOR CLEAN ROOM DEVICES

BACKGROUND OF INVENTION

1. Field of the Invention

The invention relates to a device and a method for exhaust air processing, in particular, in clean room devices. The device comprises at least one fresh air supply and at least one exhaust air device which are connected to a work room, in particular, a machine room, storage room or a laboratory room, in which at least one processing device is arranged to which are connected at least one supply line and at least one exhaust air line. According to the method, supply air is supplied to a work room and/or at least one processing device and a pollutant-laden exhaust air stream that exits the processing device is supplied to a supply air flow.

2. Description of the Related Art

In the clean room technology, in particular, in the case of semiconductor manufacturing, wherein the semiconductor products to be processed are wet-etched, wet-cleaned, and/or chemically and mechanically polished, the corresponding processing devices are installed in a machine room or laboratory. It is required that generally from such rooms, in particular, in the presence of employees, a minimum amount of exhaust air must be removed which serves for removal of excess heat, for reduction of the concentration of risk materials or for fulfilling government regulations. Risk in this context means the sum of corrosion risks, contamination risks, and health risks, wherein corrosion relates to damage of the materials of the installation, contamination relates to soiling of a product that may be handled, and health risks relate to employees possibly being present. Many installations, in particular, in the area of clean room technology are however provided with a removal volume which is above the aforementioned limits. This is expensive primarily because the removed air must be replaced with freshly prepared ambient air.

It is known to return clean room air into the circulating air while pollutant-laden or risk-carrying air from processing devices is expelled into the exhaust air.

It is also known to return the risk-free air flows again into the room air and to clean the exhaust air of hoods in laboratories, typically 500 $Nm^3/h$ or less, via filters based on activated charcoal and to return it into the room air.

SUMMARY OF INVENTION

It is an object of the invention to configure a device and a method of the aforementioned kind such that the risk-carrying exhaust air flows can be cleaned and returned in a simple and inexpensive way.

This object is solved in accordance with the invention for the device of the aforementioned kind in that at least one filter is arranged in the exhaust air line of the processing device and that the exhaust air line is connected to the supply line of the processing device and/or of the work room. According to the method of the invention, the exhaust air at the processing device side is cleaned to remove high-risk pollutants before being returned into the air supply flow.

As a result of the configuration according to the invention, the risk-carrying air of the processing device is cleaned and returned. In this way, a large portion of the exhaust air of the processing device side can be reused so that it must not be replaced with fresh air. In this way, the amount of exhaust air as well as the amount of supplied fresh air can be reduced significantly which results in significant cost savings.

BRIEF DESCRIPTION OF DRAWINGS

The invention will be described in the following in more detail with the aid of several embodiments illustrated in the drawings. It is shown in.

DETAILED DESCRIPTION

Figure 1:
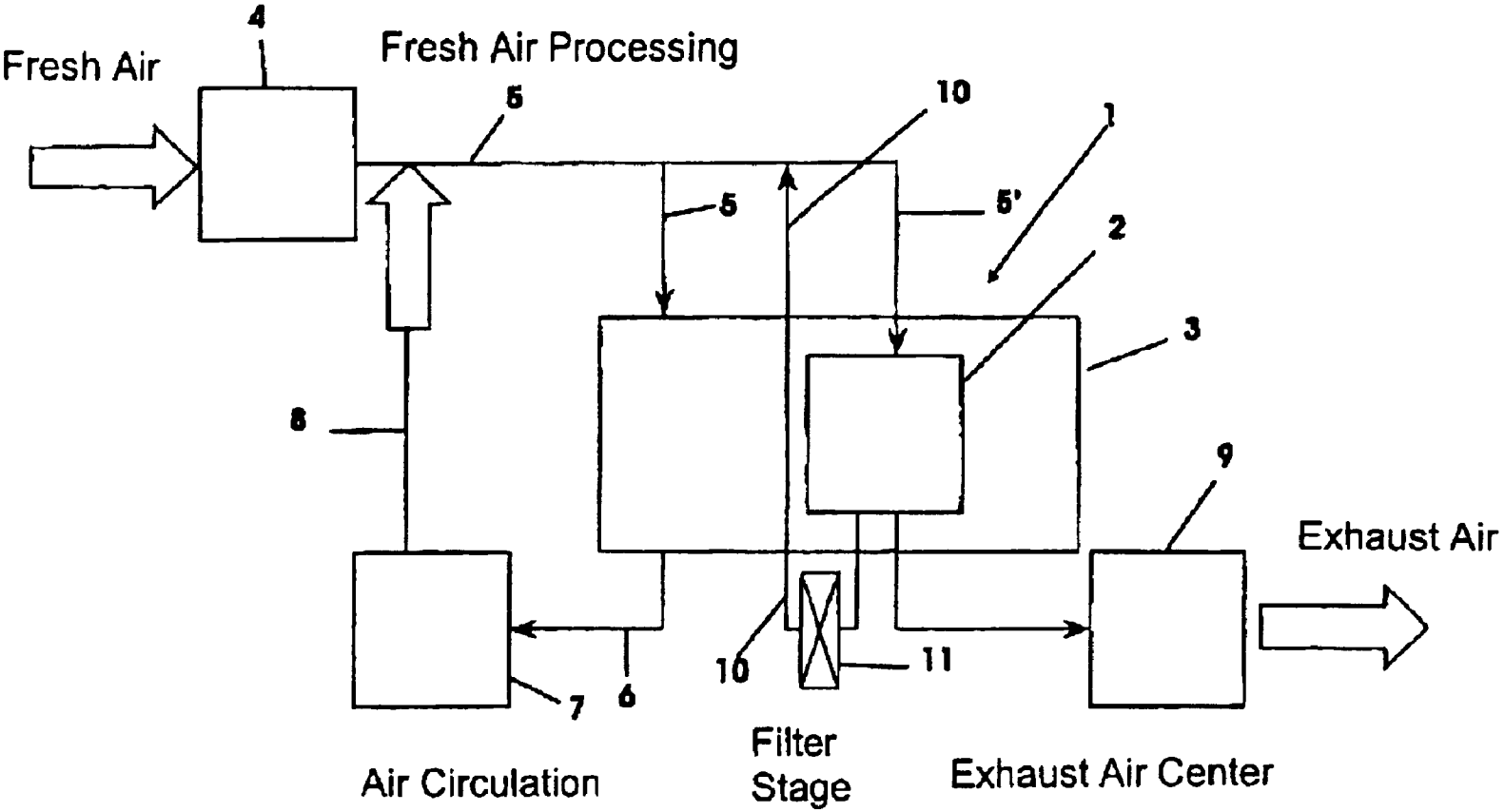
FIG. 1 a device according to the invention for processing exhaust air in a schematic illustration.

The device 1 according to FIG. 1 serves for processing exhaust air of processing devices 2, such as, for example, devices for wet etching, for cleaning, for chemical mechanical polishing in semiconductor manufacturing as well as electroplating devices. The device 1 can comprise simply one processing device 2 as illustrated in FIG. 1, but also several processing devices 2. The processing device 2 is arranged in a work room 3 which is supplied by means of a fresh air intake device 4 via at least one line 5 with fresh air. By means of a branch line 5', the processing device 2 is also provided with fresh air. The fresh air supply can also be realized indirectly via the work room 3. In this case, the branch line 5' is not required. The fresh air flows from the top to the bottom through the work room 3, advantageously in laminar flow. The exhaust air which exits the work room 3 is supplied by means of at least one line 6 of a recirculating air device 7 which returns the exhaust air via at least one line 8 into the supply line 5. The device 1 can also be provided with a laboratory instead of the work room 3.

In the line 5, the return exhaust air of the work room 3 is mixed with the fresh air supplied by the intake device 4 in order to supply the thus processed air to the work room 3 and/or the processing device 2.

The fresh air which is separately supplied via line 5' flows through the process device 2 from the top to the bottom and entrains gases which are generated during use of the processing device 2. The exhaust air exiting from the processing device is risk-carrying and is acidic or alkaline without relevant proportions of organic materials so that it can result in health risks for the persons working in the work room or laboratory. Such exhaust air is generated primarily during wet etching or cleaning or during chemical-mechanical polishing in semiconductor manufacturing. Acidic exhaust air is also generated, in particular, in electroplating facilities. Such risk-carrying exhaust air flows can also lead to corrosion of the processing devices or other objects in the work room as well as to contamination of the products to be treated, in particular, semiconductor products. A portion of the processing device exhaust air is supplied to an exhaust air device 9 and removed from the device 1.

The residual portion of the risk-carrying exhaust air of the processing device 2 is supplied via a line 10 to the line 5 or 5', is mixed therein with fresh air/supply air flowing in via the line 5, and then again supplied via the line 5' to the processing device 2. In order to reduce or neutralize the acid or base contents in the processing device exhaust air, at least one filter 11 is arranged in the line 10. It is an ion exchange device with which, for example, at 100 Pa pressure loss, a flow of 5000 $Nm^3/h$ with a 99.5% degree of separation can be filtered. Under such processing conditions the use of activated carbon filters would not be expedient because the capacity and the degree of separation even of impregnated coal types in technically expedient pressure loss ranges of approximately 100 Pa is limited or the typical airflow of 5000 $Nm^3/h$ is too high for the application and the filter medium cannot be regenerated. Moreover, in the aforementioned typical exhaust air flows an increased moisture contents is to be expected as a result of the employed open aqueous baths in the processing machine which makes the use of coal filters more difficult while, however, favoring ion exchange filters. When, for example, 20 $\mu g/m^3$ HF is used which must be reached or surpassed so that corrosion in the concerned air channels does not occur and health risks are excluded, air flows with concentrations of smaller than or equal to 4 $mg/m^3$ HF are suitable for this type of recycling. In the mentioned airflow of 5000 $m^3/h$, 20 g/h are removed and the filter service life of this typical ion exchange filter with 10 kg filter mass is then 12 hours. For uninterrupted operation (24 hours) twice daily a regeneration is to be provided which advantageously must be realized without demounting. When the loading of the filters is lower, a regeneration with removal of the filter can be carried out, optionally. Accordingly, the spent filter medium can be regenerated as described with the aid of FIGS. 3 and 4. An internal regeneration can be provided where the filter medium must not be removed. However, an external regeneration is possible also for which purpose the filter medium is removed from the filter 11. This can be achieved by means of parallel (FIG. 3) or serial switching (FIG. 4) of the filter 11 with at least one additional filter 12 without this requiring an interruption of operation.

The ion exchange filter 11, depending on its configuration, retains the acidic or alkaline components of the exhaust air which is supplied in the described way after filtering to the same processing device 2. The processing device exhaust air is thus recirculated.

Cleaning of the filter 11 can be carried out simply and quickly without special expenditure. Exhaust air that has been cleaned with the filter 11 is cleaned so effectively that neither health nor corrosion or contamination risks occur when returned to the fresh airflow of the processing device 2.

Figure 3:
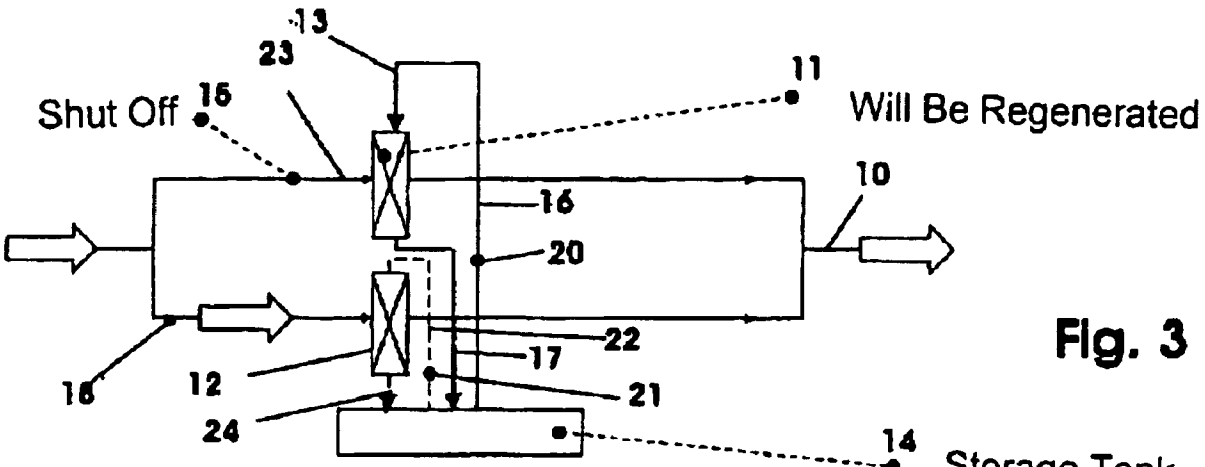
FIG. 3 in a schematic illustration a device for regenerating the filter stage of the device according to FIG. 2.

For regenerating the filter medium, sodium hydroxide, hydrochloric acid or sulfuric acid can be used, for example. FIG. 3 shows the situation with two filters 11, 12 positioned parallel to one another and switchable alternatingly to be connected to a regeneration circuit. The filter 11 is positioned in the regeneration circuit 13 in which at least one storage tank 14 for the regeneration medium is provided. It flows via a line 16 from the storage tank 14 to the filter 11 to be regenerated. The medium flows through the filter 11, regenerates the filter medium, and is returned via the line 17 to the storage tank. For the circulation of the regeneration medium a pump (not illustrated) is provided. During the regeneration phase, the supply of the exhaust air at the processing device side to the filter 11 is shut off by the valve 15. The exhaust air flow is then guided through the parallel filter 12, is cleaned therein in the described way, and supplied to the line 10 via which the cleaned exhaust air reaches the line 5 (FIG. 1).

When the filter 11 is regenerated, the valve 15 is opened and a valve 18 in the inlet line 19 to the filter 12 is closed. Moreover, a valve 20 in the regeneration line 16 is closed and a valve 21 in a regeneration line 22 connected to the storage tank 14 is opened. The exhaust air of the processing device side now flows via a line 23 from the line 2 to the regenerated filter 11, is cleaned therein, and returns via the line 10 to the line 5 (FIG. 1).

Parallel to this cleaning operation in the cleaning circuit of the exhaust air, the filter 12 is regenerated. The regeneration medium is conveyed from the storage container 14 via line 22 to the filter 12 whose medium is being regenerated. Subsequently, the regeneration medium flows via a line 24 back to the storage tank 14.

In the described way, the filters 11, 12 can be alternatingly regenerated so that during regeneration the operation of the device 1 or the cleaning of the exhaust air of the processing device side must not be interrupted.

Figure 4:
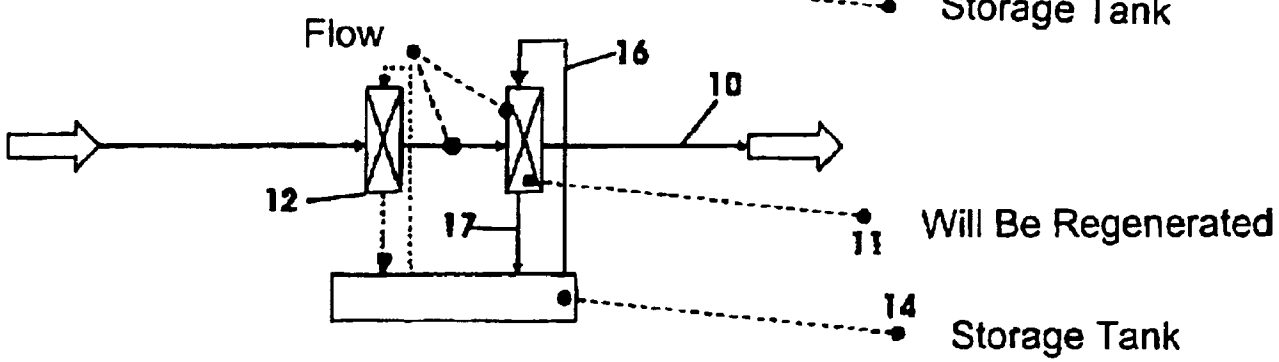
FIG. 4 in a schematic illustration a device for regenerating the filter stage of the device according to FIG. 2.

In the serial connection according to FIG. 4, the filters 11, 12 are configured such that each filter 11, 12 can be regenerated individually while the other filter is connected to the process circuit and cleans the exhaust air of the processing device side. In the illustrated embodiment, the filter 11 is regenerated. The regeneration medium flows via line 16 from the storage tank 14 into this filter, flows therethrough and regenerates the filter medium contained therein. The regeneration medium flows via the line 17 back to the storage tank 14. Parallel to this regeneration phase the exhaust air of the processing device side flows through the filter 12, and is filtered therein as described above, and then returned via the line 10 to the line 5 (FIG. 1).

The regeneration circuit can be switched such that the regenerated filter 11 can be switched to be connected to the process circuit and the other filter 12 to the regeneration circuit. Switching is carried out in the embodiment according to FIG. 3 with corresponding valves (not illustrated) with which the filters 11, 12 can be switched alternatingly into the regeneration circuit and into the process circuit. During regeneration, the operation of the device and cleaning of the exhaust air of the processing device side are not interrupted.

Figure 2:
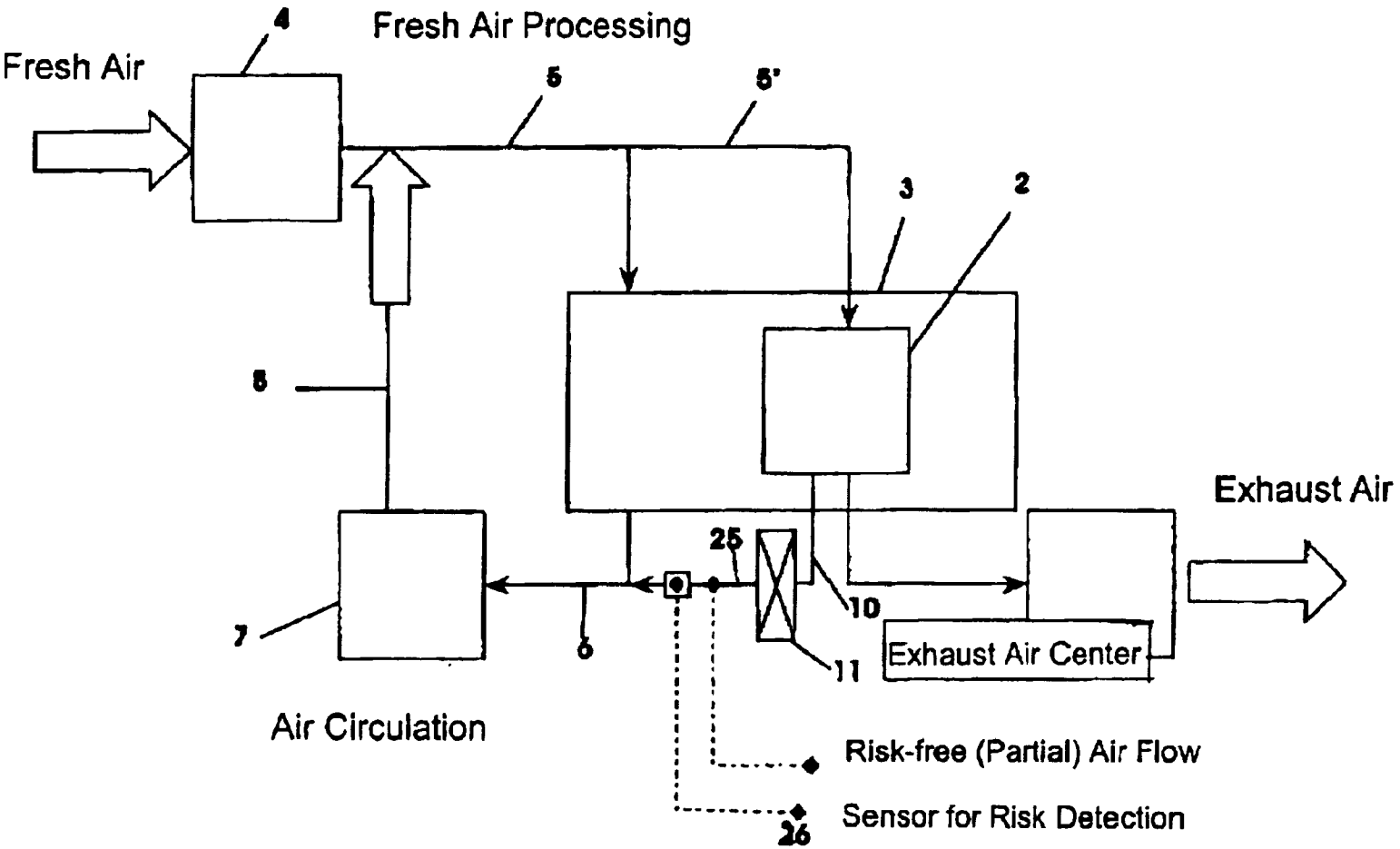
FIG. 2 a second embodiment of the device according to the invention in a schematic illustration.

As illustrated in FIG. 2, the cleaned exhaust air of the process device 2 can also be returned into the work room 3. In this case, the filter 11 is connected by a line 25 to a line 6 extending to the air recirculating device 7. In the flow direction behind the filter 11 a sensor 26 is seated in the line 25 which indicates possibly present pollutants in the filter exhaust air stream. The filtered exhaust air stream is added upstream of the circulating device 7 to the exhaust air of the work room 3 flowing in the line 6. Via the line 8 the circulating flow is then again supplied into the lines 5 and 5' which supply the gas stream to the working chamber 3 or the process device 2. Otherwise, the device according to FIG. 3 is identical to the device of FIG. 1.

With the described devices it is possible in a simple and inexpensive way to achieve a significant reduction of the total exhaust air. In this way, the amount of supply air to be added via the fresh air supply device 4 is substantially smaller so that, in turn, cost savings are obtained.

While specific embodiments of the invention have been shown and described in detail to illustrate the inventive principles, it will be understood that the invention may be embodied otherwise without departing from such principles.

What is claimed is:

1. A device for exhaust air processing of clean rooms, the device comprising:

at least one fresh air supply having at least one supply line;

at least one exhaust air device;

at least one work room;

at least one processing device arranged in the at least one work room;

a recirculating air device;

wherein the at least one supply line is connected to the at least one work room;

wherein the at least one air supply line has a branch line connected to the at least one processing device;

at least one first exhaust air line connected to the at least one processing device for removing exhaust air from the processing device;

at least one second exhaust air line connected to the at least one exhaust air device for exhausting air from the at least one processing device through the at least one exhaust air device;

at least one first filter arranged in the at least one first exhaust air line;

wherein the at least one first exhaust air line returns exhaust air that has been filtered in the at least one first filter device to the at least one air supply line;

wherein the at least one work room has at least one return line connected to the recirculating device and wherein the recirculating device is connected to the at least one supply line.

2. The device according to claim 1, wherein the at least one first exhaust air line of the at least one processing device opens into the return line of the at least one work room.

3. The device according to claim 1, wherein the at least one first filter is an ion exchanger.

4. The device according to claim 1, wherein the at least one work room is a storage room and wherein the exhaust air removed from the storage room is container breathing air or leakage air of a chemical container.

5. The device according to claim 1, comprising at least one sensor arranged in the at least one first exhaust air line of the at least one processing device for risk detection.

6. The device according to claim 5, wherein the at least one sensor is arranged downstream of the at least one first filter in the flow direction of the exhaust airflowing in the at least one first exhaust line of the at least one processing device.

7. The device according to claim 1, wherein the at least one first filter is configured to be regenerated.

8. The device according to claim 1, further comprising at least one second filter correlated with the at least one first filter, wherein the at least one second filter is connected parallel, connected in series, or connected in series and parallel to the at least one first filter.

9. The device according to claim 8, wherein the first and second filters are switchable to be connected to a regeneration circuit and are configured to be regenerated.

10. The device according to claim 9, comprising at least one storage tank for a regeneration medium positioned in the regeneration circuit.

11. The device according to claim 9, wherein the first and second filters are parallel connected and configured to be alternatingly connected to the regeneration circuit.

12. The device according to claim 9, wherein the regeneration circuit contains a regeneration medium, wherein the regeneration medium is an acid or a base.

13. The device according to claim 8, wherein the at least one second filter is configured identically to the at least one first filter.

14. The device according to claim 12, wherein the acid is hydrochloric acid or sulfuric acid and wherein the base is sodium hydroxide.

15. The device according to claim 6, wherein the at least one second filter is an ion exchanger.

16. A method for exhaust air processing in a device comprising at least one fresh air supply having at least one supply line; at least one exhaust air device; at least one work room; at least one processing device arranged in the at least on work room; a recirculating air device; wherein the at least one supply line is connected to the at least one work room; wherein the at least one air supply line has a branch line connected to the at least one processing device; at least one first exhaust air line connected to the at least one processing device for removing exhaust air from the processing device; at least one second exhaust air line connected to the at least one exhaust air device for exhausting air from the at least one processing device through the at least one exhaust air device; at least one first filter arranged in the at least one first exhaust air line; wherein the at least one first exhaust air line returns exhaust air that has been filtered in the at least one first filter device to the at least one air supply line; wherein the at least one work room has at least one return line connected to the recirculating device and wherein the recirculating device is connected to the at least one supply line; wherein the method comprises the steps of:

suppling supply air as a supply airflow to at least one work room and directly to at least one processing device through a branch line;

cleaning a pollutant-laden exhaust air stream exiting the at least one processing device by a filter arranged in an exhaust air line connected to the least one processing device to remove high-risk pollutants; and returning the exhaust air stream after cleaning into the supply air flow.

17. The method according to claim 16, further comprising the step of regenerating a filter medium of the at least one first filter during cleaning of the pollutant-laden exhaust air.

18. The method according to claim 16, wherein during the step of regenerating the exhaust air of the at least one processing device is guided through at least one second filter.

19. The method according to claim 18, wherein one of the first and second filters is regenerated while another of the first and second filters is used for cleaning the exhaust air of the at least one processing device.

* * * * *